US010668592B2

(12) United States Patent
Lee et al.

(10) Patent No.: US 10,668,592 B2
(45) Date of Patent: Jun. 2, 2020

(54) METHOD OF PLANARIZING A WAFER

(71) Applicant: TAIWAN SEMICONDUCTOR MANUFACTURING COMPANY, LTD., Hsinchu (TW)

(72) Inventors: Bo-I Lee, Sindian (TW); Soon-Kang Huang, Hsinchu (TW); Chi-Ming Yang, Hsinchu (TW); Chin-Hsiang Lin, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 15/003,258

(22) Filed: Jan. 21, 2016

(65) Prior Publication Data

US 2016/0136776 A1 May 19, 2016

Related U.S. Application Data

(63) Continuation of application No. 13/420,366, filed on Mar. 14, 2012, now Pat. No. 9,242,342.

(51) Int. Cl.
*B24B 37/20* (2012.01)
*B24B 53/017* (2012.01)

(52) U.S. Cl.
CPC ..... *B24B 37/20* (2013.01); *B24B 53/017* (2013.01)

(58) Field of Classification Search
CPC ..... B24B 53/017; B24B 53/12; B24D 18/00; B24D 3/06
USPC ..... 451/443, 539; 51/309, 293, 298
See application file for complete search history.

(56) References Cited

U.S. PATENT DOCUMENTS 4,119,500 A 10/1978 Ishizuka et al.
4,916,869 A 4/1990 Oliver
5,131,924 A * 7/1992 Wiand ..... B24D 11/001 51/293
5,250,084 A * 10/1993 Lansell ..... B24D 18/00 51/293
5,380,390 A 1/1995 Tselesin
5,392,982 A 2/1995 Li
5,401,283 A 3/1995 Dyer et al.
(Continued)

FOREIGN PATENT DOCUMENTS

KR 10-2007-0094820 9/2007
KR 10-2009-0078647 7/2009
(Continued)

OTHER PUBLICATIONS

Office Action dated May 8, 2015 from corresponding No. TW 102106643.
(Continued)

*Primary Examiner* — Marc Carlson
(74) *Attorney, Agent, or Firm* — Hauptman Ham, LLP

(57) ABSTRACT

A method of planarizing a wafer includes pressing the wafer against a planarization pad. The method further includes moving the planarization pad relative to the wafer. The method further includes conditioning the planarization pad using a pad conditioner. Conditioning the planarization pad includes moving the planarization pad relative to the pad conditioner. The pad conditioner includes abrasive particles having aligned tips a substantially constant distance from a surface of substrate of the pad conditioner.

20 Claims, 5 Drawing Sheets

(56) References Cited

U.S. PATENT DOCUMENTS 5,584,045 A 12/1996 Tanabe et al.
5,817,204 A 10/1998 Tselesin
6,159,087 A * 12/2000 Birang ..... B24B 53/017 451/526
6,294,224 B1 * 9/2001 Akedo ..... B24D 3/06 427/131
6,368,198 B1 * 4/2002 Sung ..... B24B 53/017 451/285
7,201,645 B2 4/2007 Sung
7,258,708 B2 * 8/2007 Sung ..... B24B 1/00 451/443
7,467,989 B2 12/2008 Lin et al.
7,507,267 B2 * 3/2009 Hall ..... B24D 3/28 51/293
8,414,362 B2 4/2013 Sung
8,545,583 B2 10/2013 Duescher
2001/0043903 A1 11/2001 D'Evelyn et al.
2005/0095959 A1 * 5/2005 Sung ..... B24B 53/017 451/56
2006/0073774 A1 * 4/2006 Sung ..... B24B 53/017 451/56
2006/0143991 A1 * 7/2006 Sung ..... B24B 1/00 51/307
2007/0033810 A1 2/2007 Sumiya et al.
2008/0250722 A1 10/2008 Sung
2008/0271384 A1 11/2008 Puthanangady et al.
2009/0145045 A1 * 6/2009 Sung ..... B24D 3/06 51/307
2009/0283089 A1 * 11/2009 Sung ..... B01J 3/062 125/15
2010/0028675 A1 2/2010 Gogotsi et al.
2011/0104989 A1 5/2011 Boutaghou et al.
2012/0060426 A1 * 3/2012 Puthanangady ..... B24B 53/017 51/309
2012/0260582 A1 10/2012 Sung
2013/0273820 A1 10/2013 Sung

FOREIGN PATENT DOCUMENTS

KR 10-2009-0082360 7/2009
TW 200940261 10/2009
WO 2006073924 7/2006
WO 2008036892 3/2008
WO 2009091140 7/2009

OTHER PUBLICATIONS

Office Action dated Nov. 29, 2013 with English translation from corresponding application No. KR 10-2012-0071732.
Office Action with English Translation dated May 15, 2013 from corresponding application No. KR 10-2012-0071732.

* cited by examiner

METHOD OF PLANARIZING A WAFER

PRIORITY CLAIM

The present application is a continuation of U.S. application Ser. No. 13/420,366, filed Mar. 14, 2012, which is incorporated herein by reference in its entirety.

BACKGROUND

The semiconductor integrated circuit (IC) industry has experienced rapid growth. Technological advances in IC materials and design have produced generations of ICs where each generation has smaller and more complex circuits than the previous generation. However, these advances have increased the complexity of processing and manufacturing ICs and, for these advances to be realized, similar developments in IC processing and manufacturing are needed. For example, planarization technology, such as a chemical mechanical polishing (CMP) process, has been implemented to planarize a substrate or one or more layers of features over the substrate in order to remove defects on the processed surface and/or increase the resolution of a lithographic process subsequently performed thereon.

DESCRIPTION OF THE DRAWINGS

One or more embodiments are illustrated by way of examples, and not by limitation, in the figures of the accompanying drawings, wherein elements having the same reference numeral designations represent like elements throughout and wherein.

DETAILED DESCRIPTION

Figure 1A:
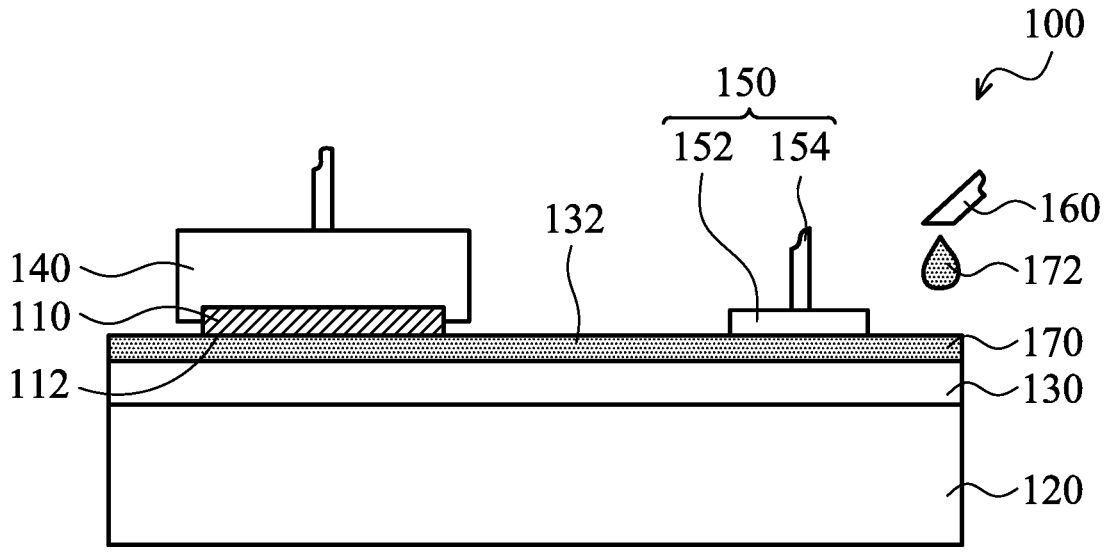
FIG. 1A is a cross-sectional view of a portion of a planarization device having a semiconductor wafer therewithin in accordance with one or more embodiments.

It is understood that the following disclosure provides many different embodiments, or examples, for implementing different features of the disclosure. Specific examples of components and arrangements are described below to simplify the present disclosure. These are, of course, examples and are not intended to be limiting. In accordance with the standard practice in the industry, various features in the drawings are not drawn to scale and are used for illustration purposes only.

The formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "below," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

FIG. 1A is a cross-sectional view of a portion of a planarization device 100 having a wafer 110 therewithin in accordance with one or more embodiments. The planarization device 100 includes a platform 120, a planarization pad 130 on the platform 120, a wafer holder 140 over the platform 120 and holding the wafer 110, a pad conditioner 150 over the platform 120, and a slurry dispenser 160 over the platform 120. In addition, during operation of the planarization device 100, a layer of slurry material 170 is over the planarization pad 130 and in contact with the planarization pad 130, a surface 112 of the wafer 110, and the pad conditioner 150. In some embodiments, the wafer 110 is a semiconductor wafer.

The slurry dispenser 160 delivers a slurry material 172 onto an upper surface 132 of the planarization pad 130 to form the layer of slurry material 170. In some embodiments, the layer of slurry material 170 includes a solution containing etchant and/or polishing grit. The upper surface 132 of the planarization pad 130 defines a reference level of flatness and supports the layer of slurry material 170. During operation of the planarization device 100, the wafer holder 140 and the planarization pad 130 are movable with respect to each other. The layer of slurry material 170 chemically etching and mechanically abrading the surface 112 of the wafer 110 in order to planarize (also being referred to as "polish") the surface 112 of the wafer 110 at a predetermined removal rate.

In some embodiments, the wafer holder 140 is rotatably mounted over the platform 120. In at least one embodiment, the platform 120 is rotatable.

The pad conditioner 150 has an abrasive member 152 mounted on a shaft 154. In some embodiments, the pad conditioner 150 is mounted over the platform 120 and rotatable about the shaft 154. In some embodiments, the upper surface 132 of the planarization pad 130 is prepared to have a predetermined range of roughness. However, during operation of the planarization device 100, the upper surface 132 of the planarization pad 130 becomes smoother. In order to keep the roughness of the upper surface 132 within the predetermined range, the abrasive member 152 is usable to scratch the upper surface 132 of the planarization pad 130 in order to maintain the roughness of the upper surface 132 and to remove any residues formed on the upper surface 132.

In some embodiments, the reconditioning of the upper surface 132 of the planarization pad 130 is performed during the polishing of the surface 112 of the wafer 110 or after the polishing of the surface 112.

Figure 1B:
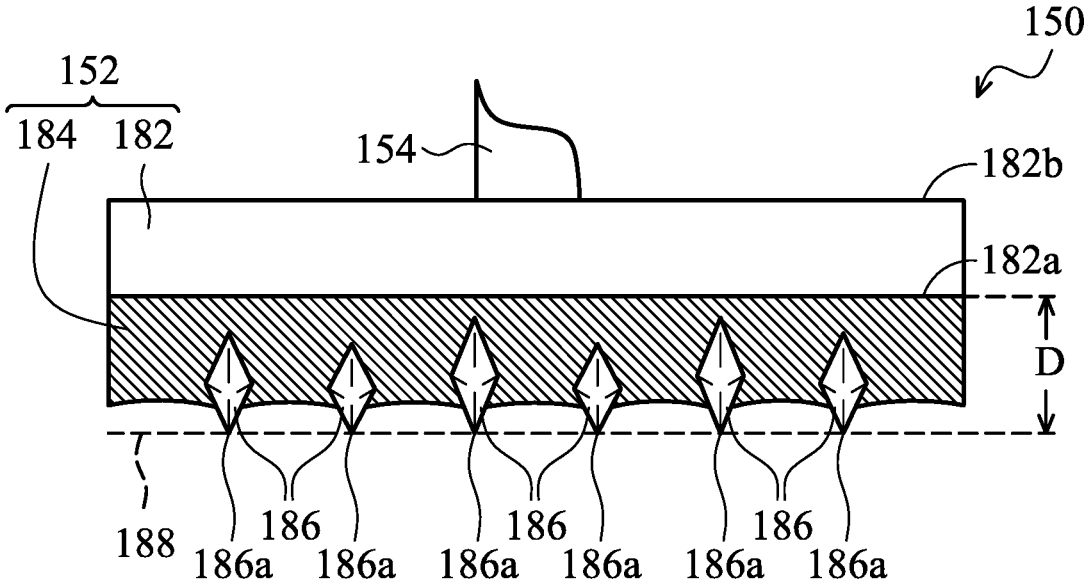
FIG. 1B is a cross-sectional view of the pad conditioner depicted in FIG. 1A in accordance with one or more embodiments.

FIG. 1B is a cross-sectional view of the pad conditioner 150 depicted in FIG. 1A in accordance with one or more embodiments. The pad conditioner 150 has an abrasive member 152 mounted on a shaft 154. The abrasive plate 152 has a substrate 182 having a first surface 182*a* and a second surface 182*b*, a reinforcement layer 184 on the first surface 182*a* of the substrate 182, and abrasive particles 186 partially buried in the reinforcement layer 184. The second surface 182*b* is usable for mounting the abrasive plate 152 to the shaft 154. Tips 186*a* of the abrasive particles 186 are substantially coplanar and define an imaginary conditioning surface 188. In some embodiments, distances between the tips 186*a* and the conditioning surface 188 range from 0% to 2% of a distance D between the conditioning surface 186 and the first surface 182*a* of the substrate 182. In some embodiments, distances between the tips 186*a* and the conditioning surface 188 range from 0% to 0.05% of the distance D.

In some embodiments, the distance D between the conditioning surface 186 and the first surface 182*a* equals the average distance between the tips 186*a* of the abrasive particles 186 and the first surface 182*a* of the substrate 182. In some embodiments, the distance D between the conditioning surface 188 and the first surface 182*a* of the substrate 182 ranges from 200 μm to 350 μm. In some embodiments, a difference between a greatest one and a least one of distances between the tips 186*a* and the conditioning surface 188 are no greater than 1 μm.

In some embodiments, the substrate 182 comprises a metallic material. In at least one embodiment, the metallic material is stainless steel. In some embodiments, the reinforcement layer 184 comprises cobalt, nickel, or solder.

In some embodiments, the abrasive particles 186 comprise a magnetic material, and thus are attractable by a magnetic force. In some embodiments, the abrasive particles 186 comprise ferromagnetic materials or paramagnetic materials. In at least one embodiment, the abrasive particles 186 are diamonds comprising a ferromagnetic material. In some embodiments, the ferromagnetic material comprises cobalt, iron, or nickel.

In some embodiments, the substrate 182 is circular or symmetrically polygonal. In some embodiments, the abrasive particles 186 are evenly distributed within a conditioning region defined on the first surface 182*a* of the substrate 182. In some embodiments, the conditioning region is a donut shape region or a circular shape region. In at least one embodiment, the conditioning region includes the entire first surface 182*a* of the substrate 182. In at least one embodiment, the substrate 182 has an asymmetrical shape.

Figure 2:
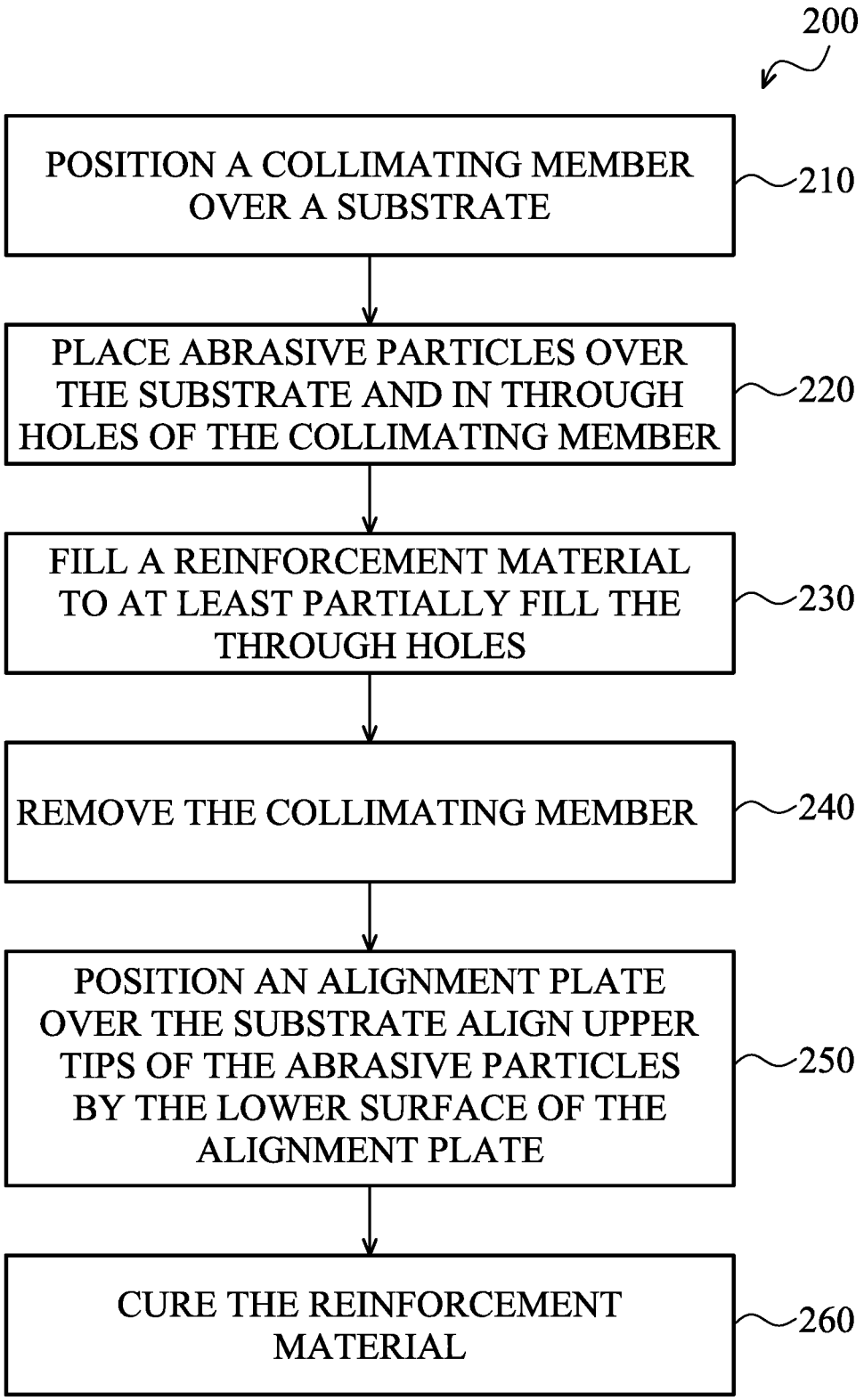
FIG. 2 is a flow chart of a method of making an abrasive plate in accordance with one or more embodiments.

FIG. 2 is a flow chart of a method 200 of making an abrasive plate (such as the abrasive plate 152 in FIGS. 1A and 1B) in accordance with one or more embodiments. FIGS. 3A-3G are cross-sectional views of an abrasive plate 300 at various manufacturing stage in accordance with one or more embodiments. In some embodiments, the abrasive plate 300 is usable as the abrasive member 152 in FIG. 1A and FIG. 1B. Compared with the abrasive plate 152 in FIG. 1B, the abrasive plate 300 is depicted in an upside down position in order to facilitate the understanding of the embodiments. It is understood that additional processes may be performed before, during, and/or after the method 200 depicted in FIG. 2, and that some other processes may only be briefly described herein.

Figure 3A:
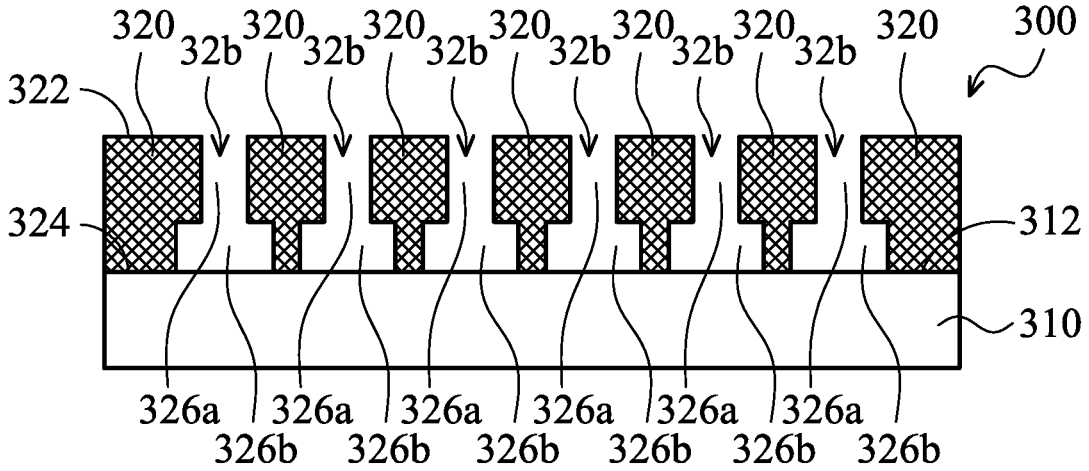
FIGS. 3A-3G are cross-sectional views of an abrasive plate at various manufacturing stages in accordance with one or more embodiments.

As depicted in FIG. 2 and FIG. 3A, in operation 210, a substrate 310 is provided for forming the abrasive plate 300, and a collimating member 320 is positioned over the substrate 310. The collimating member 320 has an upper surface 322, a lower surface 324, and through holes 326 defined therein and exposing portions of an upper surface 312 of the substrate 310. The lower surface 324 of the collimating member 320 is placed adjacent to the upper surface 312 of the substrate 310. Each of the through holes 326 has an upper opening 326*a* at the upper surface 322 and a lower opening 326*b* at the lower surface 324, and a cross-sectional area of the upper opening 326*a* is greater than that of the lower opening 326*b*. In some embodiments, the cross-sectional area of the upper opening 326*a* is equal to or less than that of the lower opening 326*b*.

Figure 3B:
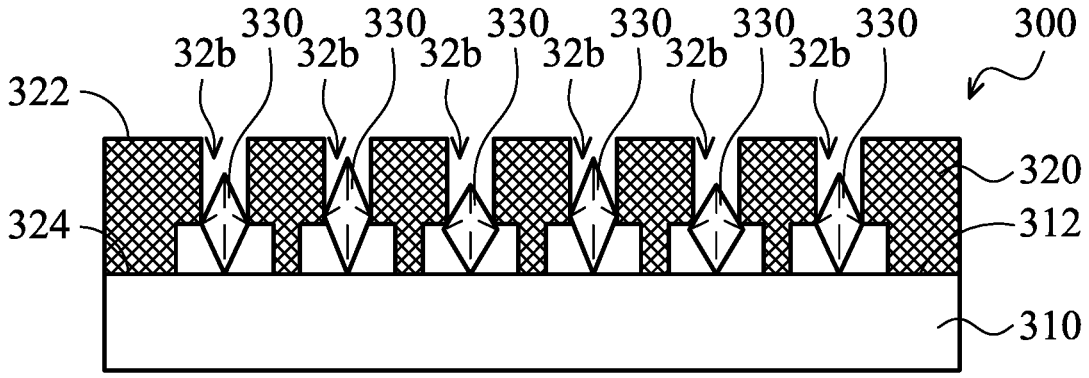

The position of the through holes 326 on the collimating member 320 is usable for defining positions of abrasive particles 330 (FIG. 3B). In some embodiments, the substrate 310 and the collimating member 320 have the same size and shape. In some embodiments, the substrate 310 and the collimating member 320 are circular or symmetrically polygonal. In some embodiments, the position of the through holes 326 is evenly distributed within a donut shape conditioning region or a circular shape conditioning region defined on the collimating member 320. In at least one embodiment, the position of the through holes 326 is evenly distributed over the entire collimating member 320.

As depicted in FIG. 2 and FIG. 3B, in operation 220, the abrasive particles 330 are placed over the upper surface 312 of the substrate 310 and in the through holes 326 of the collimating member 320. In some embodiments, only one of the abrasive particles 330 is placed in a corresponding one of the through holes 326. In at least one embodiment, the upper opening 326*a* at the upper surface 322 of the collimating member 320 are usable to align all abrasive particles 330 substantially along a direction perpendicular to a planar direction of the substrate 310. In some embodiments, the abrasive particles 330 are randomly placed on a portion of the upper surface 322 of the collimating member 320 and swept to other portion of the upper surface 322 by a brush. While being swept along the upper surface 322 of the collimating member 320, abrasive particles 330 randomly fall into the through holes 326.

In some embodiments, the abrasive particles 330 are diamonds. In some embodiments, the dimension of the diamonds ranges from 150 μm to 300 μm.

Figure 3C:
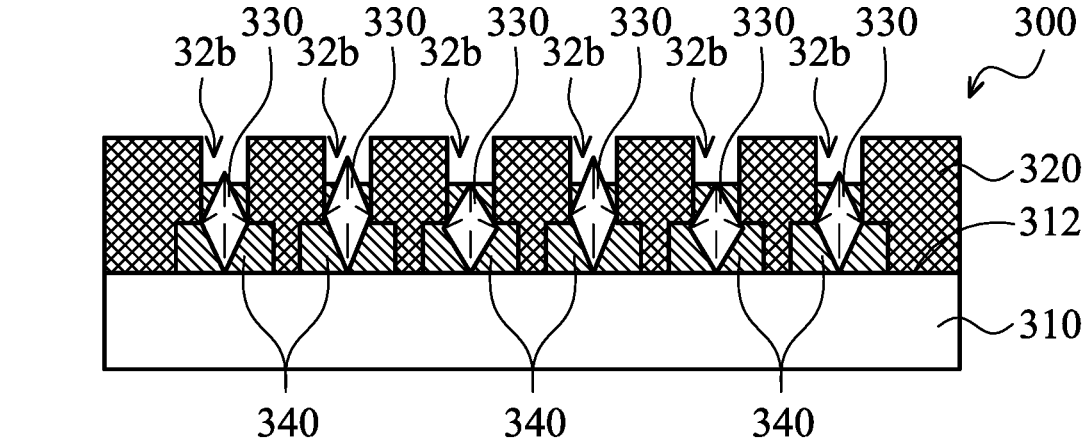

As depicted in FIG. 2 and FIG. 3C, in operation 230, a reinforcement material 340 is filled into the through holes 326 and at least partially fills the through holes 326. In some embodiments, the reinforcement material 340 is a paste or a gel that is subject to deformation upon external forces or pressures. In some embodiments, the reinforcement material 340 includes a paste containing cobalt, or nickel. In some embodiments, the reinforcement material 340 is a solder paste including tin and/or silver.

In some embodiments, the reinforcement material 340 is first placed on a portion of the upper surface 322 of the collimating member 320 and subsequently swept to other portions of the upper surface 322 by a blade. While being swept along the upper surface 322 of the collimating member 320, the reinforcement material 340 flows into and partially fills the through holes 326.

Figure 3D:
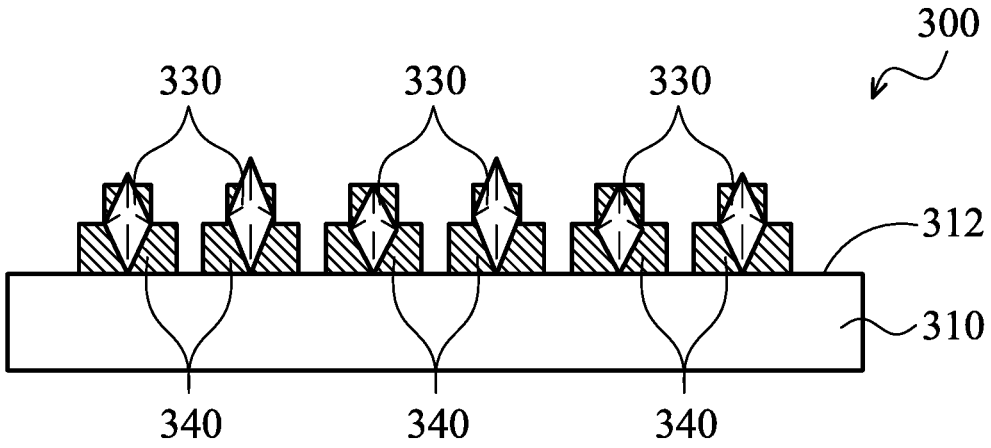
Figure 3E:
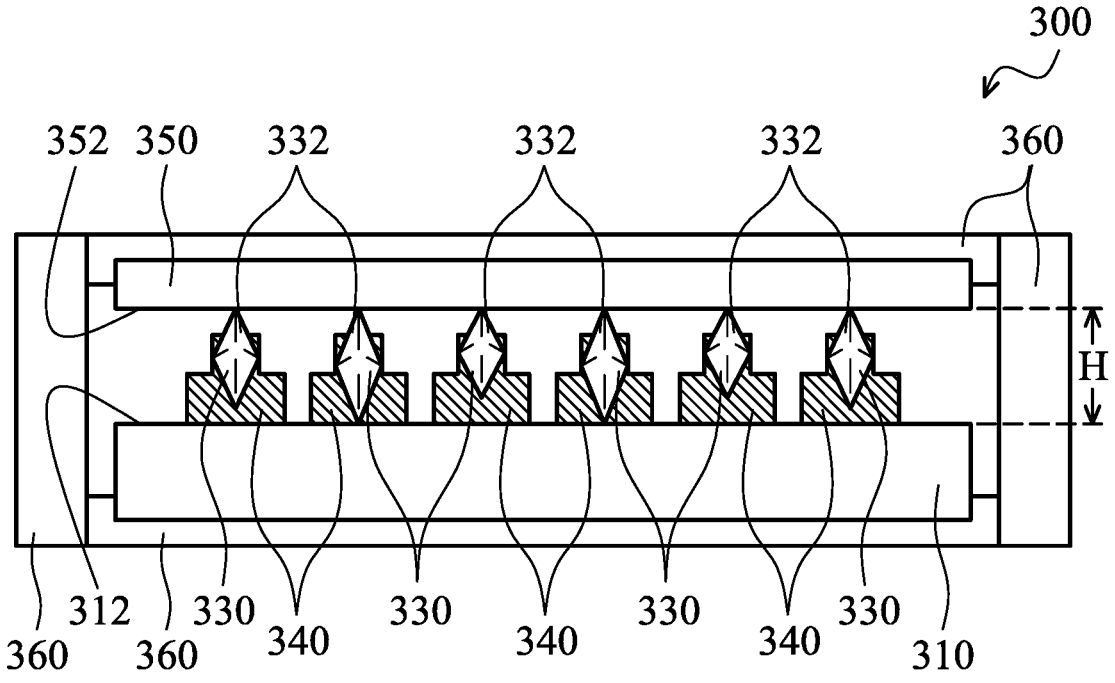

As depicted in FIG. 2 and FIG. 3D, in operation 240, the collimating member 320 is removed from the upper surface 312 of the substrate 310. As depicted in FIG. 2 and FIG. 3E, in operation 260, an alignment plate 350 is positioned over the substrate 310. The alignment plate 350 has a lower surface 352, and upper tips 332 of the abrasive particles 330 are aligned by using the lower surface 352 of the alignment plate 350. In some embodiments, distances of any point on the lower surface 352 to an upper surface 312 of the substrate ranging from 98% to 100% of an average vertical distance H between the lower surface 352 of the alignment plate 350 and the upper surface 312 of the substrate 310. In some embodiments, distances of any point on the lower surface 352 to an upper surface 312 of the substrate ranging from 99.95% to 100% of the average vertical distance H. In some embodiments, the distance H ranges from 200 μm to 350 μm.

In some embodiments, the alignment plate 350 is held by a clamping device 360 that also holds the substrate 310. In some embodiments, spacers are placed over the substrate 310 in order to separate the substrate 310 from the alignment plate 350 at a predetermined average distance H, and then the alignment plate 350 is placed over the spacers.

The alignment plate 350 is capable of attracting the abrasive particles 330 to allow contact between the upper tips 332 of the abrasive particles 330 and the lower surface 352 of the alignment plate 350. In some embodiments, the abrasive particles 330 were originally in contact with the upper surface 312 of the substrate 310 because of the gravity as depicted in FIG. 3D. The alignment plate 350 attracts and pulls the abrasive particles 330 upward to align the upper tips 335 of the abrasive particles 330.

In some embodiments, the abrasive particles 330 comprise a magnetic material and are attractable by a magnetic force, and the attraction of the abrasive particles 330 is performed by using the magnetic force. In at least one embodiment, the alignment plate 350 is a magnet, and the abrasive particles 330 are diamonds having ferromagnetic impurities such as cobalt, iron, or nickel.

Figure 3F:
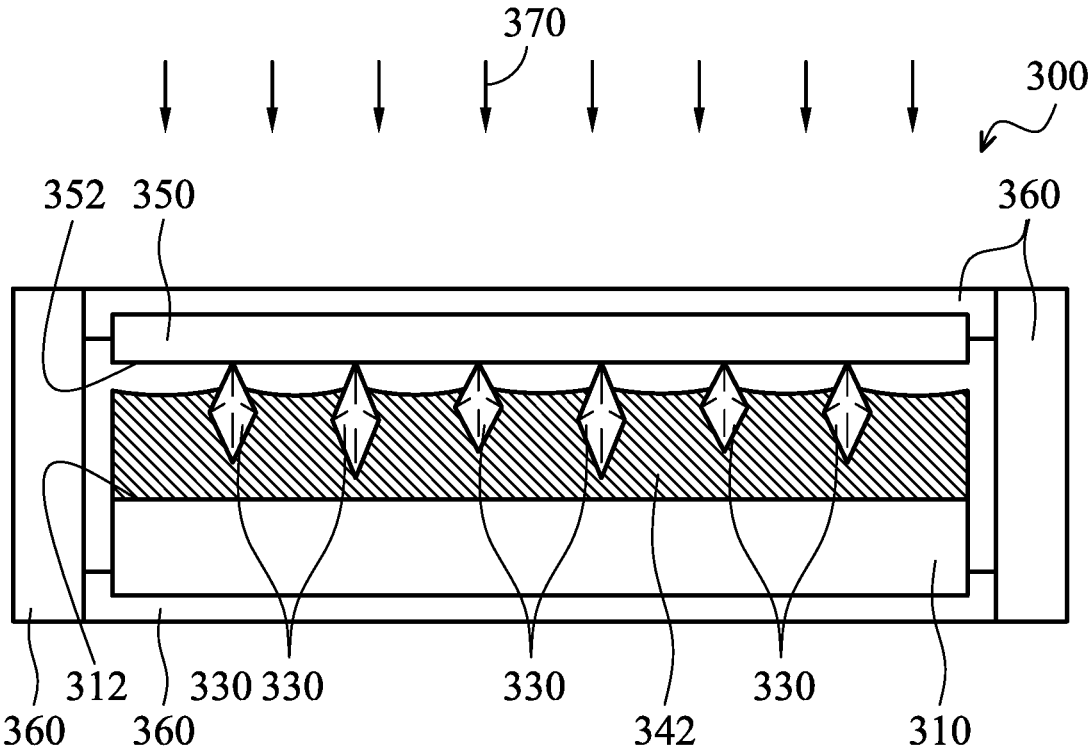

As depicted in FIG. 2 and FIG. 3F, in operation 260, a process 370 is performed to cure the reinforcement material 340 to form a layer of reinforcement material 342. In some embodiments, the process 370 includes heating the reinforcement material 340 at an environment having a temperature no less than 1000° C. In some embodiments, the process 370 includes heating the reinforcement material 340 at a predetermined temperature for a predetermined period of time that is sufficient to convert the reinforcement material 340 into a state that is rigid enough to hold the abrasive particles 330 at their respective position after being aligned based on the upper surface 312 of the substrate 310. In some embodiments, the term "cure" and "curing" also refer to "reflow" or "reflowing" the reinforcement material 340 to form the layer of reinforcement material 342.

Figure 3G:
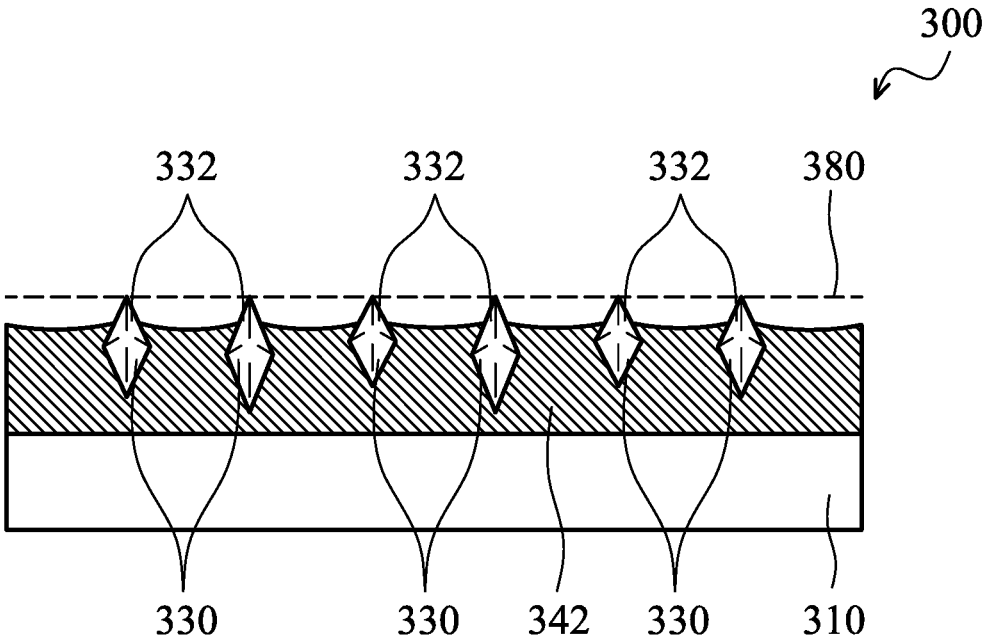

As depicted in FIG. 3G, the clamping device 360 and the alignment plate 350 are subsequently removed after the formation of the layer of reinforcement material 342. Because of the alignment performed based on the alignment plate 350, the upper tips 332 of the abrasive particles 330 are substantially coplanar along a reference plane 380, which is also referred to as a conditioning surface 380 of the abrasive plate 300. The abrasive plate 300 is usable as the abrasive plate 152 in FIG. 1B, and the relationship among the upper tips 332, the conditioning plane 380, and the substrate 310 is similar to that of the tips 186*a*, the conditioning plane 188, and the substrate 182 depicted in FIG. 1B.

One aspect of this description relates to a method of planarizing a wafer. The method includes pressing the wafer against a planarization pad. The method further includes moving the planarization pad relative to the wafer. The method further includes conditioning the planarization pad using a pad conditioner. Conditioning the planarization pad includes moving the planarization pad relative to the pad conditioner. The pad conditioner includes abrasive particles having aligned tips a substantially constant distance from a surface of substrate of the pad conditioner.

Another aspect of this description relates a method of planarizing a wafer. The method includes pressing the wafer against a planarization pad. The method includes dispensing a slurry onto the planarization pad. The method further includes rotating the planarization pad relative to the wafer. The method further includes conditioning the planarization pad using a pad conditioner. Conditioning the planarization pad includes moving the planarization pad relative to the pad conditioner. The pad conditioner includes abrasive particles having aligned tips a constant distance from a surface of substrate of the pad conditioner.

Still another aspect of this description relates to a method of planarizing a wafer. The method includes pressing the wafer against a planarization pad, wherein pressing the wafer against the planarization pad smoothes a surface of the planarization pad. The method further includes dispensing a slurry onto the surface of planarization pad. The method further includes rotating the planarization pad relative to the wafer. The method further includes roughening the surface of the planarization pad using a pad conditioner. Conditioning the planarization pad includes moving the planarization pad relative to the pad conditioner. The pad conditioner includes abrasive particles having aligned tips a constant distance from a surface of substrate of the pad conditioner.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of planarizing a wafer, the method comprising:

pressing the wafer against a planarization pad;

moving the planarization pad relative to the wafer; and conditioning the planarization pad using a pad conditioner, wherein conditioning the planarization pad comprises moving the planarization pad relative to the pad conditioner, and the pad conditioner comprises:

a plurality of abrasive particles embedded in a reinforcement layer, wherein at least three consecutive adjacent abrasive particles of the plurality of abrasive particles have aligned tips a substantially constant distance from a surface of a substrate of the pad conditioner, and a first distance, in a direction perpendicular to the surface of the substrate, from a first location on a top surface of the reinforcement layer to an aligned tip of a first abrasive particle of the plurality of abrasive particles is different from a second distance, in the direction perpendicular to the surface of the substrate, from a second location on the top surface of the reinforcement layer to the aligned tip of the first abrasive particle, wherein each abrasive particle of the plurality of abrasive particles comprises ferromagnetic material impurities that enable magnetic alignment of each abrasive particle of the plurality of abrasive particles, the method of planarizing the wafer comprises embedding the plurality of abrasive particles in the reinforcement layer and the embedding comprises:

filling a reinforcement material to at least partially fill through holes of a collimating member, the through holes of the collimating member being at least partially occupied by the plurality of abrasive particles;

removing the collimating member; and curing the reinforcement material to provide the reinforcement layer.

2. The method of claim 1, further comprising dispensing a slurry onto the planarization pad.

3. The method of claim 2, wherein conditioning the planarization pad comprises contacting the planarization pad with the plurality of abrasive particles through the slurry.

4. The method of claim 1, wherein conditioning the planarization pad occurs simultaneously with pressing the wafer against the planarization pad.

5. The method of claim 1, wherein conditioning the planarization pad comprises maintaining placement of the plurality of abrasive particles using the reinforcement layer having a concave top surface.

6. The method of claim 1, wherein conditioning the planarization pad comprises maintaining the first abrasive particle of the plurality of abrasive particles in contact with the substrate of the pad conditioner, and maintaining a second abrasive particle of the plurality of abrasive particles spaced from the substrate of the pad conditioner.

7. The method of claim 1, wherein conditioning the planarization pad comprises maintaining a difference between a third distance from the surface of the substrate of the pad conditioner and a surface of the planarization pad and a fourth distance from the aligned tip of each abrasive particle of the plurality of abrasive particles and the surface of the substrate of the pad conditioner within a range of 0% to 2% of the third distance.

8. The method of claim 1, wherein conditioning the planarization pad comprises maintaining a difference between a third distance from the surface of the substrate of the pad conditioner and a surface of the planarization pad and a fourth distance from the aligned tip of each abrasive particle of the plurality of abrasive particles and the surface of the substrate of the pad conditioner within a range of 0% to 0.05% of the third distance.

9. The method of claim 1, wherein conditioning the planarization pad comprises maintaining a distance from the surface of the substrate of the pad conditioner to a surface of the planarization pad ranging from 200 microns (μm) to 350 μm.

10. The method of claim 1, wherein conditioning the planarization pad comprises maintaining a distance from the surface of the substrate of the pad conditioner to a surface of the planarization pad substantially equal to a distance between adjacent abrasive particles of the plurality of abrasive particles.

11. The method of claim 1, wherein conditioning the planarization pad comprises maintaining a difference between a maximum distance between adjacent abrasive particles of the plurality of abrasive particles and a minimum distance between adjacent abrasive particles of the plurality of abrasive particles to be less than or equal to 1 μm.

12. A method of planarizing a wafer, the method comprising:

pressing the wafer against a planarization pad;

dispensing a slurry onto the planarization pad;

rotating the planarization pad relative to the wafer; and conditioning the planarization pad using a pad conditioner, wherein conditioning the planarization pad comprises moving the planarization pad relative to the pad conditioner, and the pad conditioner comprises:

a plurality of abrasive particles embedded in a reinforcement layer, wherein at least three adjacent abrasive particles of the plurality of abrasive particles have aligned tips a constant distance from a surface of a substrate of the pad conditioner, a height of a first abrasive particle of the plurality of abrasive particles is different from a height of a second abrasive particle of the plurality of abrasive particles, and a top surface of the reinforcement layer between adjacent abrasive particles of the plurality of abrasive particles is concave, wherein a distance between a lowermost tip of the first abrasive particle and the surface of the substrate of the pad conditioner is different from a distance between a lowermost tip of the second abrasive particle and the surface of the substrate of the pad conditioner, and wherein the plurality of abrasive particles comprises magnetic material impurities that enable magnetic alignment of the plurality of abrasive particles, the method of planarizing the wafer comprises embedding the plurality of abrasive particles in the reinforcement layer and the embedding comprises:

filling a reinforcement material to at least partially fill through holes of a collimating member, the through holes of the collimating member being at least partially occupied by the plurality of abrasive particles;

removing the collimating member; and curing the reinforcement material to provide the reinforcement layer.

13. The method of claim 12, wherein conditioning the planarization pad occurs simultaneously with pressing the wafer against the planarization pad.

14. The method of claim 12, wherein conditioning the planarization pad occurs sequentially with pressing the wafer against the planarization pad.

15. The method of claim 12, wherein conditioning the planarization pad comprises maintaining placement of the plurality of abrasive particles using the reinforcement layer having a thickness in a direction perpendicular to the top surface of the substrate which varies across the reinforcement layer.

16. The method of claim 12, wherein conditioning the planarization pad comprises maintaining a first abrasive particle of the plurality of abrasive particles in contact with the substrate of the pad conditioner, and maintaining a second abrasive particle of the plurality of abrasive particles spaced from the substrate of the pad conditioner.

17. The method of claim 12, wherein conditioning the planarization pad comprises maintaining a difference between a maximum distance between adjacent abrasive particles of the plurality of abrasive particles and a minimum distance between adjacent abrasive particles of the plurality of abrasive particles to be less than or equal to 1 μm.

18. A method of planarizing a wafer, the method comprising:

pressing the wafer against a planarization pad, wherein pressing the wafer against the planarization pad smoothes a surface of the planarization pad;

dispensing a slurry onto the surface of planarization pad;

rotating the planarization pad relative to the wafer; and roughening the surface of the planarization pad using a pad conditioner, wherein roughening the surface of the planarization pad comprises moving the planarization pad relative to the pad conditioner, and the pad conditioner comprises:

a plurality of abrasive particles, in a reinforcement material, wherein all abrasive particles of the plurality of abrasive particles have aligned tips a constant distance from a surface of a substrate of the pad conditioner, and a height, in a direction perpendicular to the surface of the substrate, of a first abrasive particle of the plurality of abrasive particles above a first location on of a top surface of the reinforcement material is different from a height, in a direction perpendicular to the surface of the substrate, of a second abrasive particle of the plurality of abrasive particles above a second location on the top surface of the reinforcement material, and wherein distances between lowermost tips of abrasive particles of the plurality of abrasive particles and the surface of the substrate of the pad conditioner are different, and wherein abrasive particles of the plurality of abrasive particles comprise magnetic material impurities that enable magnetic alignment of the abrasive particles of the plurality of abrasive particles, the method of planarizing the wafer comprises embedding the plurality of abrasive particles in the reinforcement layer and the embedding comprises:

filling a reinforcement material to at least partially fill through holes of a collimating member, the through holes of the collimating member being at least partially occupied by the plurality of abrasive particles;

removing the collimating member; and curing the reinforcement material to provide the reinforcement layer.

19. The method of claim 18, wherein roughening the surface of the planarization pad comprises scratching the surface of the planarization pad to remove residue from the surface of the planarization pad.

20. The method of claim 18, wherein conditioning the planarization pad comprises maintaining a distance from the surface of the substrate of the pad conditioner to a surface of the planarization pad substantially equal to a distance between adjacent abrasive particles of the plurality of abrasive particles.

* * * * *